United States Patent [19]

Berman

[11] 4,185,820

[45] Jan. 29, 1980

[54] MECHANICAL QUIZ GAME

[76] Inventor: Oded Berman, Tel-Aviv, Israel

[21] Appl. No.: 820,330

[22] Filed: Jul. 29, 1977

[51] Int. Cl.[2] ..... A63F 9/00

[52] U.S. Cl. ..... 273/1 E; 35/9 R; 35/9 E

[58] Field of Search ..... 273/1 R, 1 E, 1 M, 144 R, 273/144 A, 201; 35/9 R, 9 E, 35 J, 69, 70, 71, 72, 31 G

[56] References Cited

U.S. PATENT DOCUMENTS

| | | | |
|---|---|---|---|
| 3,010,226 | 11/1961 | Kalnins | 35/69 X |
| 3,458,204 | 7/1969 | Wilson | 273/201 |
| 3,773,327 | 11/1973 | Kremer | 35/35 J |
| 3,883,137 | 5/1975 | Bengtson | 273/1 R |

*Primary Examiner*—Paul E. Shapiro

*Attorney, Agent, or Firm*—Browdy and Neimark

[57] ABSTRACT

A mechanical quiz game comprising a plurality of paired quiz cards, a race defining at the finish thereof a socket and apparatus for releasing a playing element for travel along the race and into the socket for indicating a response to the paired quiz cards. Rotatable card holders are also provided as are cards having a printed correct answer code at the edges thereof.

13 Claims, 10 Drawing Figures

MECHANICAL QUIZ GAME

FIELD OF THE INVENTION

The present invention relates to mechanical quiz games and to quiz games in general.

BACKGROUND OF THE INVENTION

Many types of quiz games are well known and require, for example, the answering of questions or the matching of colors or shapes. In game situations where the same question is put to more than one player it is often desirable to provide means for unambiguously determining priority in answering the questions.

The present invention seeks to provide a mechanical quiz game having a feature which permits unambiguous indication of which player answers a question first.

SUMMARY OF THE INVENTION

In accordance with an embodiment of the present invention there is provided a mechanical quiz game comprising: a plurality of paired quiz cards; a race defining at the finish thereof a socket; and means for indicating a response to the quiz cards by selectably releasing a playing element for travel along the race and into the socket.

In accordance with a preferred embodiment of the invention the indicating means are provided at each player location and are coded to correspond to particular answers to problems posed on the quiz cards.

The quiz cards may call for matching of shapes, numbers, colors or answers with given questions. Alternatively, any other type of quiz medium may be represented on the cards and coded such that the correct answer is identified with one of the selectable indicating means.

BRIEF DESCRIPTION OF THE DRAWINGS

The present invention will be more fully understood and appreciated from the following detailed description taken in conjunction with the drawings in which.

Figure 1:
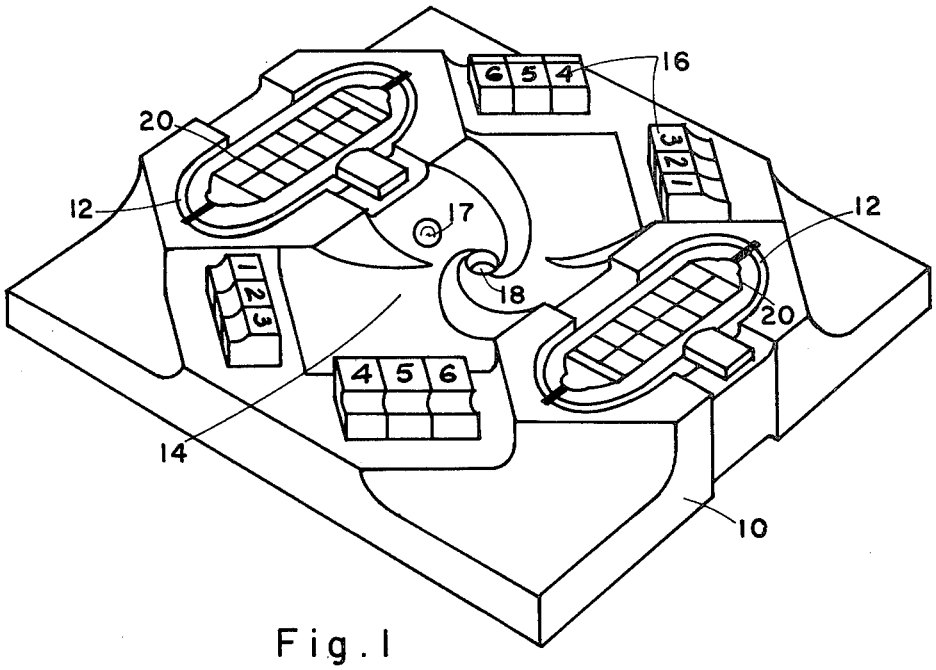
FIG. 1 shows a mechanical quiz game constructed and operative in accordance with an embodiment of the invention.
Figure 8:
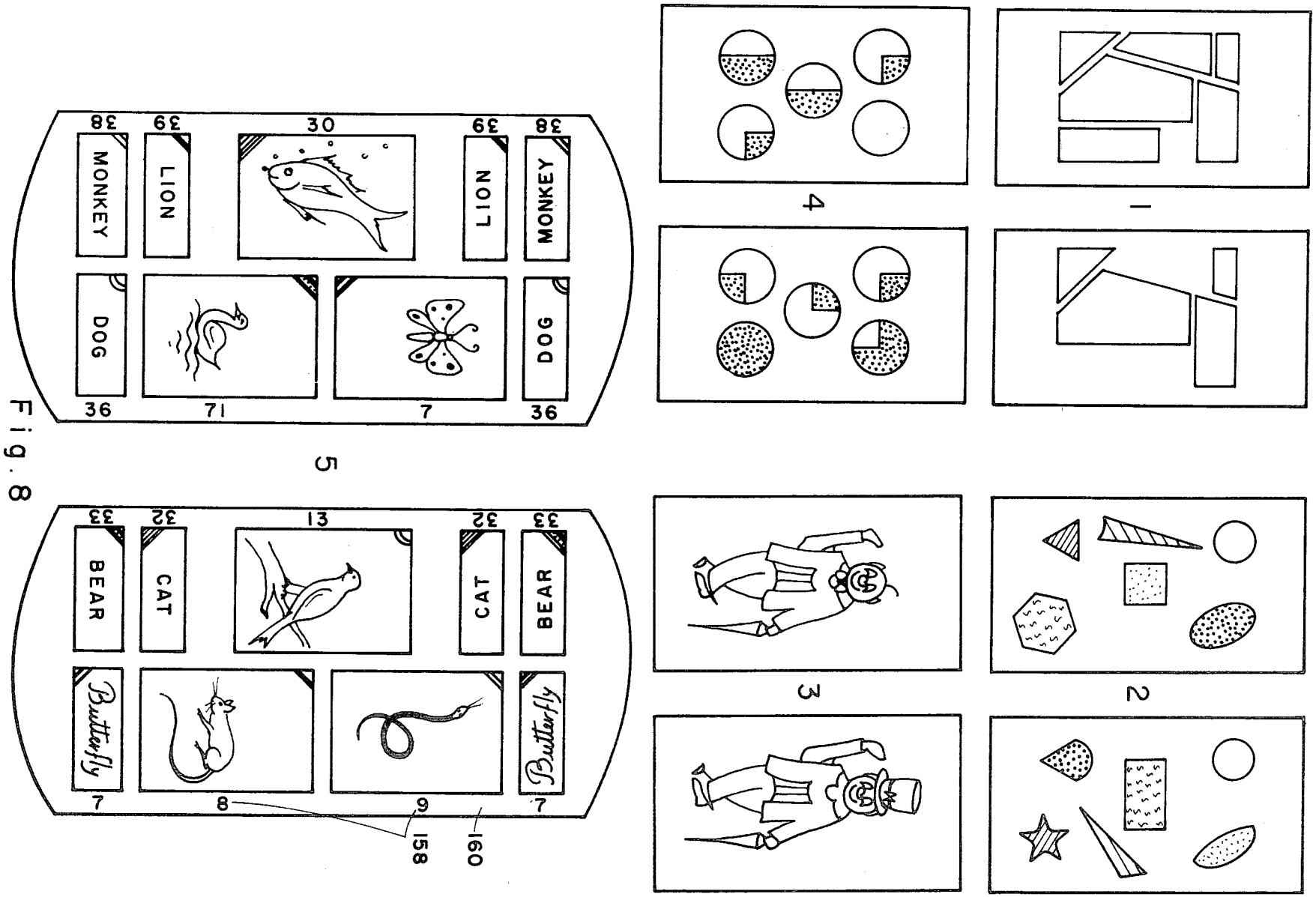

FIG. *6a* shows a linkage useful in the game illustrated in FIG. 1;

FIG. *6b* is a schematic illustration of an alternative linkage useful in the embodiment illustrated in FIG. 1;

FIG. *7a* is an illustration of quiz card mounting means useful in an embodiment of the invention;

FIG. *7b* is a side view illustration of card mounting means illustrating the insertion and removal of cards; and FIG. 8 is an array of sets of matched quiz cards usable in the embodiments of FIGS. 1 and 3–5.

DETAILED DESCRIPTION OF THE INVENTION

Referring now to FIG. 1 there is shown a mechanical quiz game constructed and operative in accordance with an embodiment of the invention and comprising a base 10, typically formed of plastic, configured to define first and second card recesses 12, a race 14 and a plurality of locations for playing piece releasing devices 16. Devices 16 are operative to release a playing piece such as a ball 17 each coded to correspond to a given device 16 for travel along the race towards a socket 18, which is formed at the center bottom portion thereof and configured to accommodate only a single playing piece. Disposed in card recesses 12 are card holders 20 which are illustrated in detail in FIGS. *7a* and *7b*.

Referring now to FIGS. *7a* and *7b* it is seen that the card holder comprises a frame member 22 having side portions 24 and end portions 26. Pivots 28 are attached to end portions 24 for pivotable mounting of holder 20. The card holder is designed to be generally symmetric on both surfaces thereof and typically comprises a center leaf 27 and two symmetric top and bottom leaves 29 and 31. The center leaf 27 defines the spacing between the side leaves as well as the path along which a card 33 may be inserted therein while the side leaves cooperate with the center leaf to define a slit 35 in each side portion 24 at which a card may be inserted. As illustrated particularly in FIG. *7b*, the members are configured and arranged so as to permit insertion of a card from one end 21 in a direction indicated generally by reference numeral 30 and along one surface 23 of the support member and removal thereof from the opposite end indicated by reference numeral 25 and alongside the opposite surface of the support member.

According to an alternative embodiment of the invention, card holder 20 may be conveniently formed out of two substantially identical molded sections which may be joined to define a configuration substantially as illustrated in FIG. *7a*.

Figure 2:
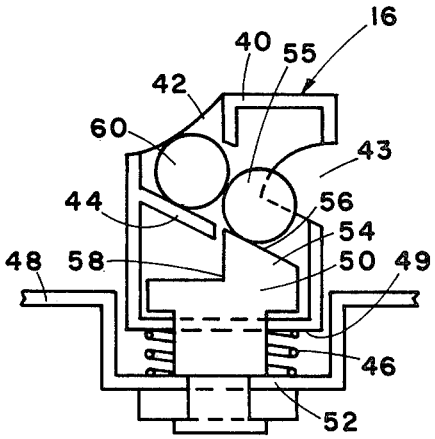
FIG. 2 is a sectional schematic illustration of selectable playing piece release means for use in the game of FIG. 1.

Reference is now made to FIG. 2 which shows a playing piece releasing device 16 in sectional illustration. The device comprises a housing 40 configured to define a ball access opening 42 adjacent the top surface thereof and a ball exit opening 43 along the side thereof. The housing is also configured to define a support surface 44 for supporting a ball inserted through access opening 42. Housing 40 is supported on a coil spring 46 which extends between a base 48 which normally comprises a portion of base 10 (FIG. 1) and a lower surface 49 of housing 40.

A displacing member 50, comprising a shaft portion 52 and an inclined support portion 54 defining a support surface 56 fixed to base 48 and arranged such that urging of housing 40 in a downward direction causes upward movement of member 50 relative to the housing and such that support surface 56 defined by support portion 54 is aligned with exit opening 43 permitting a ball indicated by reference numeral 55 supported on surface 56 to exit from housing 40 via opening 43. Member 50 is also constructed to define a facing surface 58 which is operative to block the downward displacement of a ball such as that indicated by reference numeral 60 and supported on support surface 44 during downward displacement of housing 40. Thus the playing piece releasing device 16 operates to release only one ball at a time.

Figure 3:
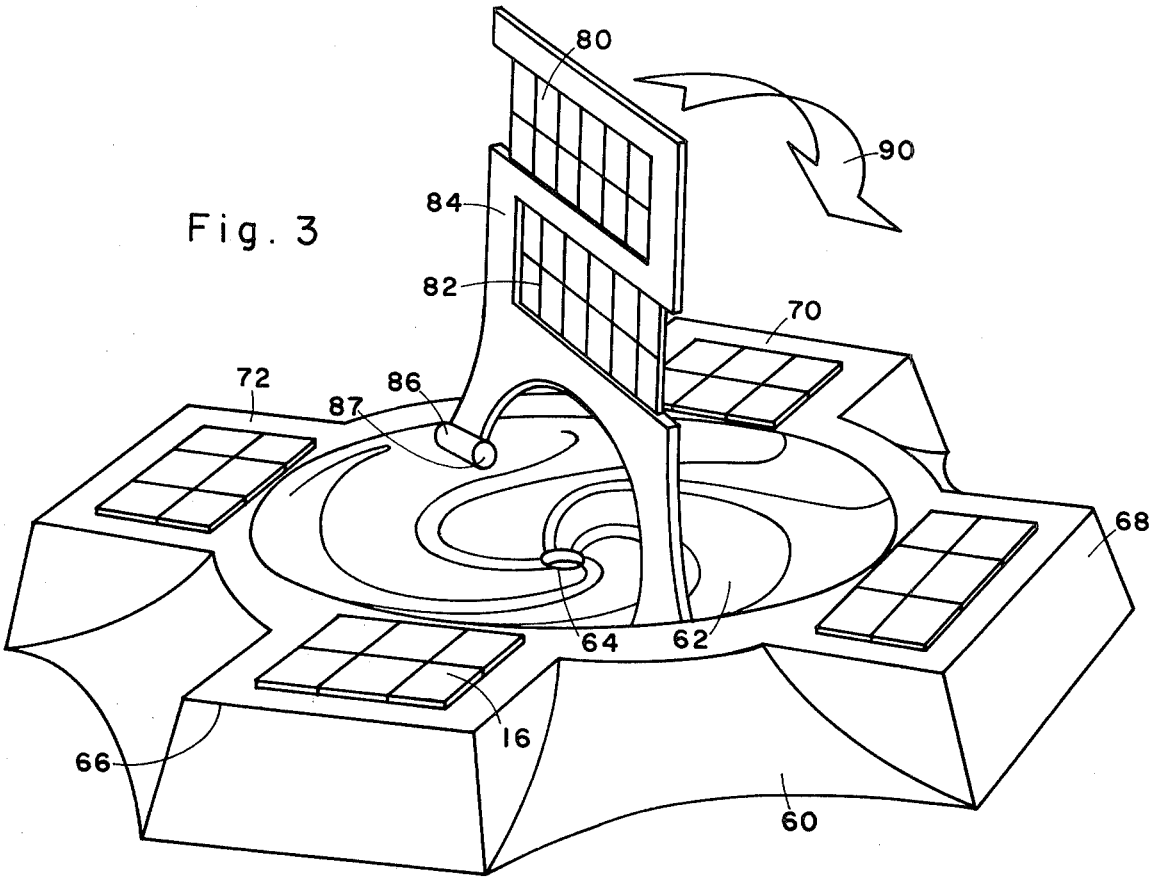
FIG. 3 is a mechanical quiz game constructed and operative in accordance with an alternative embodiment of the invention.

Reference is now made to FIG. 3 which shows an alternative embodiment of a mechanical quiz game constructed and operative in accordance with the present invention and which comprises a base 60 defining a race 62 having a central socket 64 for receiving a single playing piece such as a ball. Arranged at a plurality of playing locations 66, 68, 70 and 72 are sets of playing piece releasing devices 16 substantially identical to those illustrated in FIG. 2 or of any other suitable type. Quiz cards 80 and 82 defining a matched set are arranged in a holder member 84 such that the extreme edges of the quiz cards are obscured from view. Holder 84 is in turn rotatably mounted on the base by any suitable means such as by a collar 86, integrally formed with member 84, which is slipped over a pin 87, fixed with respect to base 60. Thus, card holder 84 can be moved from a first position wherein the questions and answers are not visible to a flipped position by rotation in a direction indicated by arrow 90 with the matched cards visible, thus presenting questions or puzzles to be solved.

Figure 4:
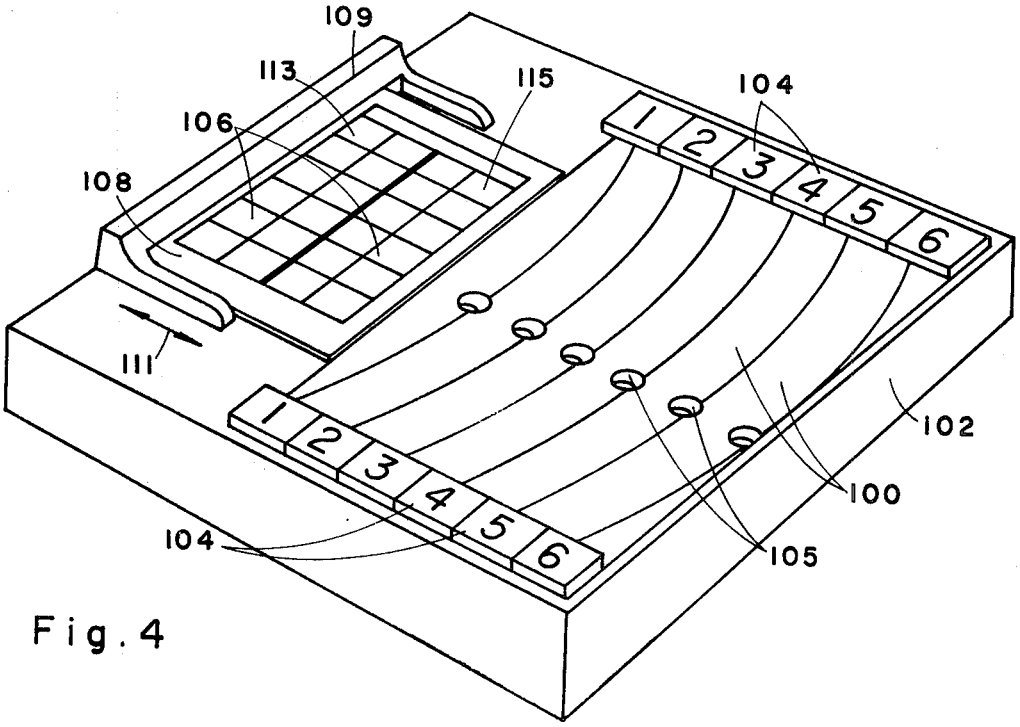
FIG. 4 is a mechanical quiz game constructed and operative in accordance with yet another embodiment of the invention.

Reference is now made to FIG. 4 which is an alternative embodiment of a mechanical quiz game constructed in accordance with the invention. Here a plurality of races 100 are each having a socket 105 defined on a base 102 and playing piece release devices 104 are mounted adjacent each race at suitable positions. Puzzle cards 106 are placed at a viewing location 108 of the device defined by base member 102.

Associated with viewing location 108 is a card transfer device 109 which moves relative to base 102 in direction indicated by arrow 111. Card transfer device 109 comprises frictional means for moving a card from a first pile exemplarily illustrated by reference numeral 113 to a second pile exemplarily illustrated by reference numeral 115. Thus it may be appreciated that if a single stack of cards is made up of alternately placed cards of two mateable sub-sets of a given series in which any one card of a sub-set may be used in association with any other card of the other sub-set of the same series, each movement of device 119 across viewing location 108 serves to bring a different pair of mateable sub-sets into view.

Figure 5:
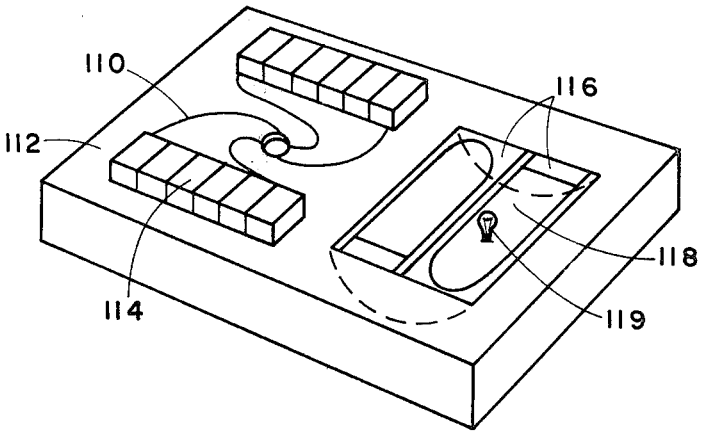
FIG. 5 is a mechanical quiz game constructed and operative in accordance with still another embodiment of the invention.
Figure 6A:
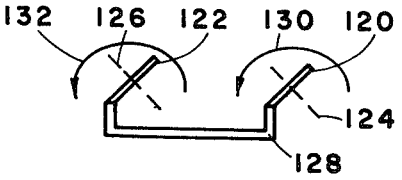
Figure 6B:
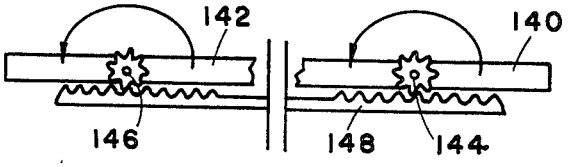
Figure 7A:
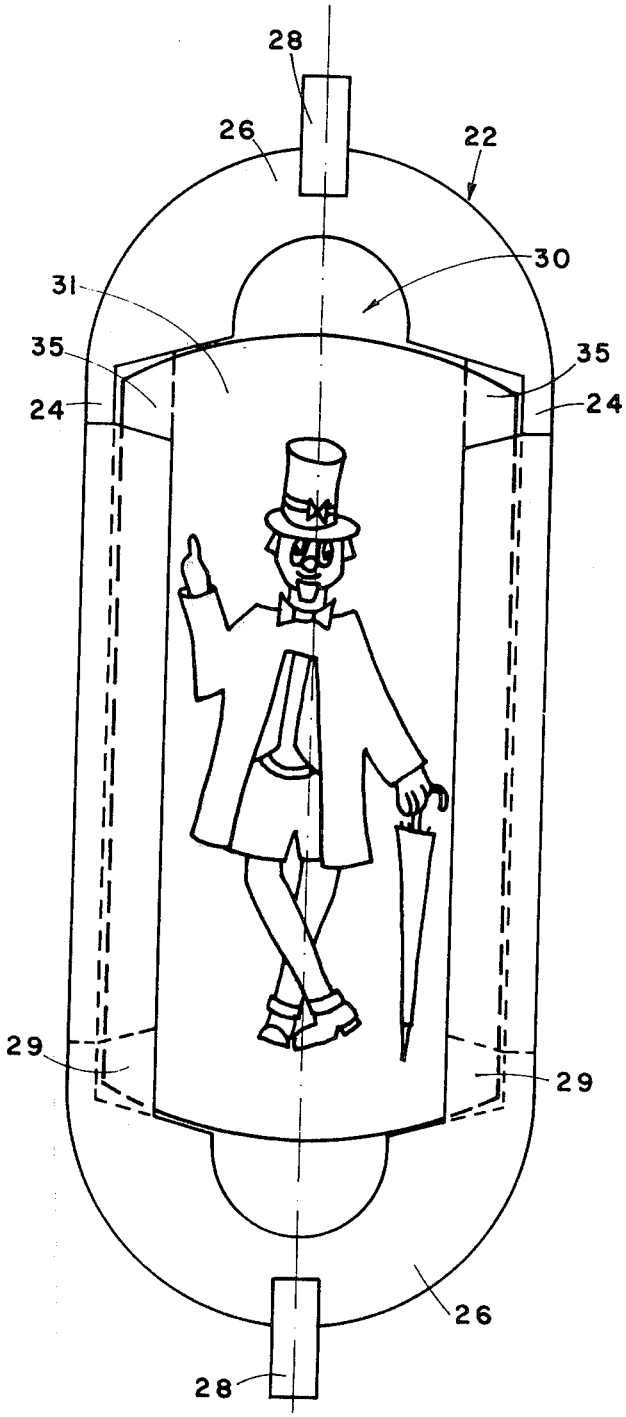
Figure 7B:
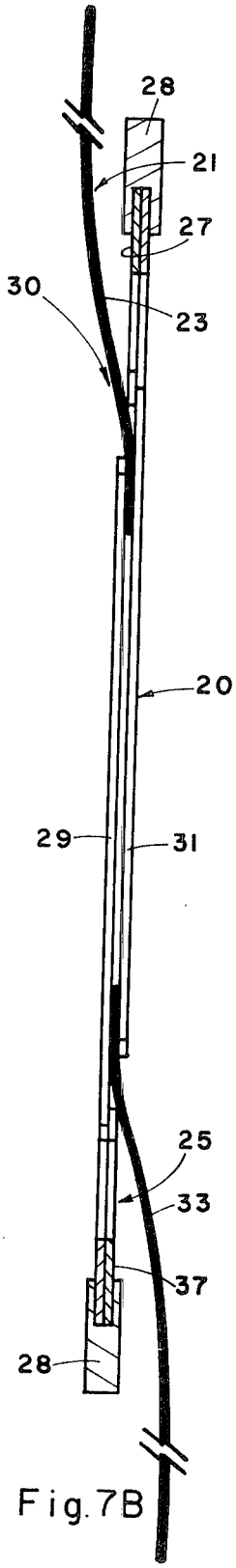

Still a further embodiment of the invention is illustrated in FIG. 5 wherein, similarly to the embodiment of FIG. 4, a race 110 is defined on a base member 112 and playing piece releasing devices 114 are arranged for dropping playing pieces such as balls onto the race for travel therealong. In accordance with this embodiment of the invention translucent quiz cards are employed and are fabricated such that they become legible only when illuminated. A pair of translucent quiz cards are inserted into card holders 116 which lie above a recess 118 in which there is disposed illuminating means 119 operable by switch means or any other suitable control device.

According to a preferred embodiment of the invention the switch means are arranged such that illuminating means 119 are operated only when both cards are fully inserted into card holder 116.

Returning briefly to the embodiment of FIG. 1 it may be appreciated that simultaneous flipping of the quiz cards 20 from side to side so as to expose the cards to view substantially simultaneously may be desirable. Two types of mechanical apparatus are suggested for accomplishing this result. The first, illlustrated in FIG. *6a* comprises a pair of linkages 120 and 122 attached to respective card holders 124 and 126. Linkages 120 and 122 are in turn connected by a rod 128 to which each of them is rotatably mounted. It may be appreciated that rotational movement of one of the card holders in a direction indicated by arrow 130 will produce a generally simultaneous rotation of card holder 126 in a direction defined by arrow 132.

An alternative mechanism for providing generally simultaneous rotation of the card holders is illustrated in FIG. *6b* wherein card holders 140 and 142 are each provided with a respective gear 144 and 146 fixedly attached to one or both of their ends. Gears 144 and 146 are in turn coupled together by a ratchet member 148 which transmits the rotational movement of an effective one of the gears in a linear fashion into rotational movement of the other one of the gears.

Reference is now made to FIG. 8 which illustrates five pairs of quiz cards of differing types. Pair No. 1 requires the player to compare the two collections of shapes and to determine the number of pieces which appear identically in both cards. Here the correct answer would be 4 and would be indicated by pressing the release device marked 4.

Card pair 4 requires the player to match shapes with colors. Here the colors are indicated by different shadings but it is seen that only the circles both have the same shading and only the circles appear on both cards. Thus the button having the indicated shading is pressed to indicate the correct answer.

In card pair 3, the object is to detect a number of differences between the images shown on the two cards. The correct answer would be 2.

In card pair 4 the object is to add the number of total circles appearing on both cards and here the answer would be 4.

Reference is now made to pair 5 in which it is necessary to match a picture on one card with the name of the animal illustrated on the other card. A hint to the correct answer is provided by color coding of both the picture and the name (here indicated on the drawing by stripes). Thus it may be appreciated that the correct answer is "butterfly" and the indicated color coating is matched with that on one of the buttons to express the answer.

It is appreciated that in accordance with an alternative embodiment of the invention confirmation of the correct answer may be provided by suitable code indicia 158 such as a color coding or a number placed in the margin 160 on the cards. Thus in the example shown, the code 7 appears alongside the "butterfly" indicia. As noted above and apparent from the drawings, particularly from FIGS. *7a* and *7b*, this margin area is normally obscured from view when the card is placed in a card holder, or is made sufficiently small so as not to be readily deciphered in the course of play. Thus in case of dispute between players the card may be removed and the answer confirming indicia examined.

It is appreciated that in card pair 5 the written word indicia such as cat, bear and butterfly are reproduced at both ends of the card to provide players with equal ease in reading the written indicia.

With further reference to card pair 5 it may be appreciated that various series of question cards may be provided. For example, pictures of animals may be matched with the names of the animals. Flags may be matched with the names of countries, quotations may be matched with the names of their authors and geometrical figures may be matched with identical fingers, etc. Each series is conveniently divided into two groups each containing, for example, six cards. The game may be played by matching any one of the cards in each group with a card in the other group. Thus, in the case where two groups, each containing six cards, are provided in a series, 36 different quiz combinations are provided.

It is appreciated that for each quiz combination there is only a single answer which may be indicated by color coding, number coding or any other suitable coding mechanism which finds expression, unambiguously by a player pressing one of the playing piece release buttons.

The instructions for playing a game using cards of the general type hereinabove described are exemplarily indicated below:

INSTRUCTIONS FOR PLAYING THE GAME

A. A series of cards is selected, the cards are shuffled and then separated when face down according to sets and colors where, for example, each set contains cards which are either brown or grey on their reverse sides. B. Player 1 sits near a set of six release devices and player 2 sits near another set of six release devices. C. Player 1 chooses one of the brown cards and inserts it into card holder face down without examining it. Player 2 chooses one of the grey cards of the same set and also inserts it into a card holder face down without examining it. D. Both card holders are rotated to expose the face of the cards. Such rotation may occur separately or simultaneously. E. When a color answer is indicate both players push a colored release device which matches the color of the indicated answer.

When both cards give a "number" answer the players push the release device on which the corresponding number is printed. Each player pushes one of his release devices even if he is late or does not know the answer. F. When both players have chosen the correct answer or both have chosen the wrong answer the player whose color ball first reaches the central socket takes both his ball and that of the other player and places them in the corresponding release device.

When only one of the players is correct he takes both balls even if his opponent's ball reaches the center socket first. G. The loser removes from the card holders one or both cards. He then places a card in each empty card holder, face down as before. The card holders are than rotated face up and again proceeds. H. The winner is the player who has possession of all the 12 balls.

When four players play the game the players are divided into two sides, each of which has six release devices. Player A of each side operates release device 1–3 while player B of each side operates release device 4–6. I. The game proceeds similarly to the game played by two players but each individual player has the right only to push the release devices which he is assigned to operate. J. A side which releases two balls loses both balls even though one player of the side has given the correct answer. K. The balls that are taken from the center socket are distributed according to their color corresponding release devices of the side that has captured them. The winning side is the side that has all 12 balls.

It will be appreciated that many other types of constructions may instead be used or suggested.

It will occur to persons skilled in the art that there are countless numbers of variations and alternatives in the structure and design of both the game apparatus and the quiz cards, all within the scope of the present invention. Therefore it is not intended that the particular embodiments described and illustrated herein limit the invention, but rather that they serve as exemplary embodiments of the invention. The invention is defined only by the claims which follow:

I claim:

1. A mechanical quiz game comprising:

a plurality of paired quiz cards, each member of each pair bearing a plurality of indicia only one of which is matchable with indicia on the other member of the pair, said matchable indicia being identifiable by coded indicia;

a race defining at the finish thereof a socket; and manually actuable means identified with said coded indicia for indicating a response to the paired quiz cards by selectably releasing a playing element for travel along the race and into the socket.

2. A mechanical quiz game according to claim 1 wherein said indicating means comprises a plurality of spring loaded means for releasing a single ball in response to manual actuation thereof.

3. A mechanical quiz game according to claim 1 and comprising a plurality of races each associated with a socket.

4. A mechanical quiz game comprising:

a plurality of paired quiz cards;

a race defining at the finish thereof a socket;

means for indicating a response to the quiz cards by selectably releasing a playing element for travel along the race and into the socket; and rotatable card holder means for securing said paired quiz cards.

5. A mechanical quiz game according to claim 4 wherein said indicating means are provided at a plurality of player locations and are coded to correspond to particular answers to problems posed on said paired quiz cards.

6. A mechanical quiz game according to claim 4 wherein said rotatable card holder means comprise linkage means for permitting substantially simultaneous flipping of quiz cards inserted in said card holder means.

7. A mechanical quiz game according to claim 4 wherein said card holder means comprise means for obscuring edge portions of said quiz cards.

8. A mechanical quiz game according to claim 4 wherein said rotatable card holder means comprises a unitary member for holding said paired quiz cards.

9. A mechanical quiz game according to claim 4 wherein said rotatable card holder means comprises an individual card holder for each of said paired quiz cards.

10. A mechanical quiz game comprising:

a plurality of paired quiz cards;

a race defining at the finish thereof a socket;

means for indicating a response to the quiz cards by selectably releasing a playing element for travel along the race and into the socket; and mechanical means for removing said paired quiz cards from a first stack onto a second stack.

11. A mechanical quiz game comprising:

a plurality of paired quiz cards;

a race defining at the finish thereof a socket;

means for indicating a response to the quiz cards by selectably releasing a playing element for travel along the race and into the socket; and illumination means for selectably illuminating said paired quiz cards.

12. A mechanical quiz game according to claim 11 wherein said illuminating means comprises switch means operative to permit operation of said illuminating means only when two paired quiz cards are located in a desired orientation.

13. A quiz game comprising a plurality of paired quiz cards, each member of each pair bearing a plurality of indicia at least one of which is matchable with indicia on the other member of the pair and code indicia arranged at the edges of each member of each pair to indicate the correct matched indicia and also comprising card holder means for permitting viewing of the matchable indicia on said paired cards but obscuring the code indicia located at the edges thereof.

* * * * *